US008813710B2

(12) United States Patent
Thomas et al.

(10) Patent No.: US 8,813,710 B2
(45) Date of Patent: Aug. 26, 2014

(54) CYLINDER HEAD ASSEMBLY AND METHOD OF FORMING THE SAME

(75) Inventors: Christopher P. Thomas, Commerce, MI (US); Alan G. Falkowski, Lake Orion, MI (US); Richard H. Sands, Holly, MI (US)

(73) Assignee: Chrysler Group LLC, Auburn Hills, MI (US)

( * ) Notice: Subject to any disclaimer, the term of this patent is extended or adjusted under 35 U.S.C. 154(b) by 129 days.

(21) Appl. No.: 13/192,012

(22) Filed: Jul. 27, 2011

(65) Prior Publication Data

US 2013/0025560 A1 Jan. 31, 2013

(51) Int. Cl.
*F02F 1/00* (2006.01)

(52) U.S. Cl.
USPC ..... 123/193.5; 123/41.35

(58) Field of Classification Search
USPC ..... 123/193.5, 193.3, 90.27, 41.35, 184.38
See application file for complete search history.

(56) References Cited

U.S. PATENT DOCUMENTS

| | | | | |
|---|---|---|---|---|
| 1,647,848 | A | 11/1927 | Woolson | |
| 2,083,323 | A | 6/1937 | Edwards | |
| 3,096,750 | A * | 7/1963 | Dolza et al. | 123/90.27 |
| 4,034,723 | A * | 7/1977 | Hamparian | 123/41.76 |
| 4,194,043 | A | 3/1980 | Lee et al. | |
| 4,785,773 | A * | 11/1988 | Schreiber et al. | 123/193.5 |
| 5,213,071 | A * | 5/1993 | Iwata et al. | 123/90.27 |
| 5,596,961 | A * | 1/1997 | Faber | 123/184.38 |
| 5,749,410 | A | 5/1998 | Uda et al. | |
| 5,901,673 | A * | 5/1999 | Ishikawa | 123/73 B |
| 6,138,631 | A * | 10/2000 | Stromsky et al. | 123/193.5 |
| 6,345,613 | B1 * | 2/2002 | Hoffmann et al. | 123/572 |
| 6,460,502 | B2 | 10/2002 | Gracyalny | |
| 6,948,463 | B2 | 9/2005 | Mischker et al. | |
| 2005/0061286 | A1 * | 3/2005 | Molina et al. | 123/193.3 |
| 2012/0138007 | A1 * | 6/2012 | Smith et al. | 123/193.5 |

FOREIGN PATENT DOCUMENTS

| | | |
|---|---|---|
| AT | 177970 B | 3/1954 |
| DE | 3030200 A1 | 2/1982 |
| GB | 1483335 | 8/1977 |

OTHER PUBLICATIONS

Photograph: Toyota 3.5L Cylinder Head—2006 Global V6 Project.

* cited by examiner

*Primary Examiner* — M. McMahon
(74) *Attorney, Agent, or Firm* — Ralph E Smith

(57) ABSTRACT

A cylinder head assembly for an internal combustion engine includes a fluid cavity that contains a fluid. The cylinder head assembly also includes a first member with a first internal surface defining a first part of the fluid cavity. Also, the assembly includes a second member with a second internal surface defining a second part of the fluid cavity. The second member is coupled to the first member. The first and second internal surfaces cooperate to define the fluid cavity.

16 Claims, 4 Drawing Sheets

CYLINDER HEAD ASSEMBLY AND METHOD OF FORMING THE SAME

FIELD

The present invention relates to a cylinder head assembly and, more particularly, relates to a cylinder head assembly having separate layered members that cooperate to define a fluid cavity therein.

BACKGROUND

Internal combustion engines typically include a cylinder head that is separately attached to an engine block. The cylinder head can include various fluid cavities therein. These fluid cavities can contain and direct the flow of fluid through the cylinder head, they can contain a set amount of fluid therein, etc.

Cylinder heads are typically formed by sand casting or other semi-permanent mold processes. Specifically, a metal mold is prepared with sand cores included therein. Then, molten metal is introduced into the mold, and the metal is solidified. Next, the sand is removed, leaving cavities within the part. Once the part is finished, these cavities can contain the fluids necessary for operation of the cylinder head and the engine.

Typically, these conventional ways of forming the cylinder head can be labor intensive. Also, a significant amount of metal is used to form the cylinder head in these ways, making the cylinder head relatively expensive to manufacture. Furthermore, the weight of the cylinder head can be quite substantial because of these conventional forming methods, and this can negatively impact fuel efficiency of the vehicle.

SUMMARY

A cylinder head assembly for an internal combustion engine is disclosed. The assembly includes a fluid cavity that contains a fluid. The cylinder head assembly also includes a first member with a first internal surface defining a first part of the fluid cavity. Also, the assembly includes a second member with a second internal surface defining a second part of the fluid cavity. The second member is coupled to the first member. The first and second internal surfaces cooperate to define the fluid cavity.

Furthermore, a method of forming a cylinder head assembly for an internal combustion engine is disclosed. The method includes forming a first member of the cylinder head assembly, wherein the first member includes a first internal surface. The method also includes forming a second member of the cylinder head assembly, wherein the second member includes a second internal surface. Additionally, the method includes coupling the first and second members together such that the first and second internal surfaces cooperate to define a fluid cavity that contains a fluid.

Further areas of applicability of the present disclosure will become apparent from the detailed description, drawings and claims provided hereinafter. It should be understood that the detailed description, including disclosed embodiments and drawings, are merely exemplary in nature intended for purposes of illustration only and are not intended to limit the scope of the invention, its application or use. Thus, variations that do not depart from the gist of the invention are intended to be within the scope of the invention.

DETAILED DESCRIPTION

Figure 1:
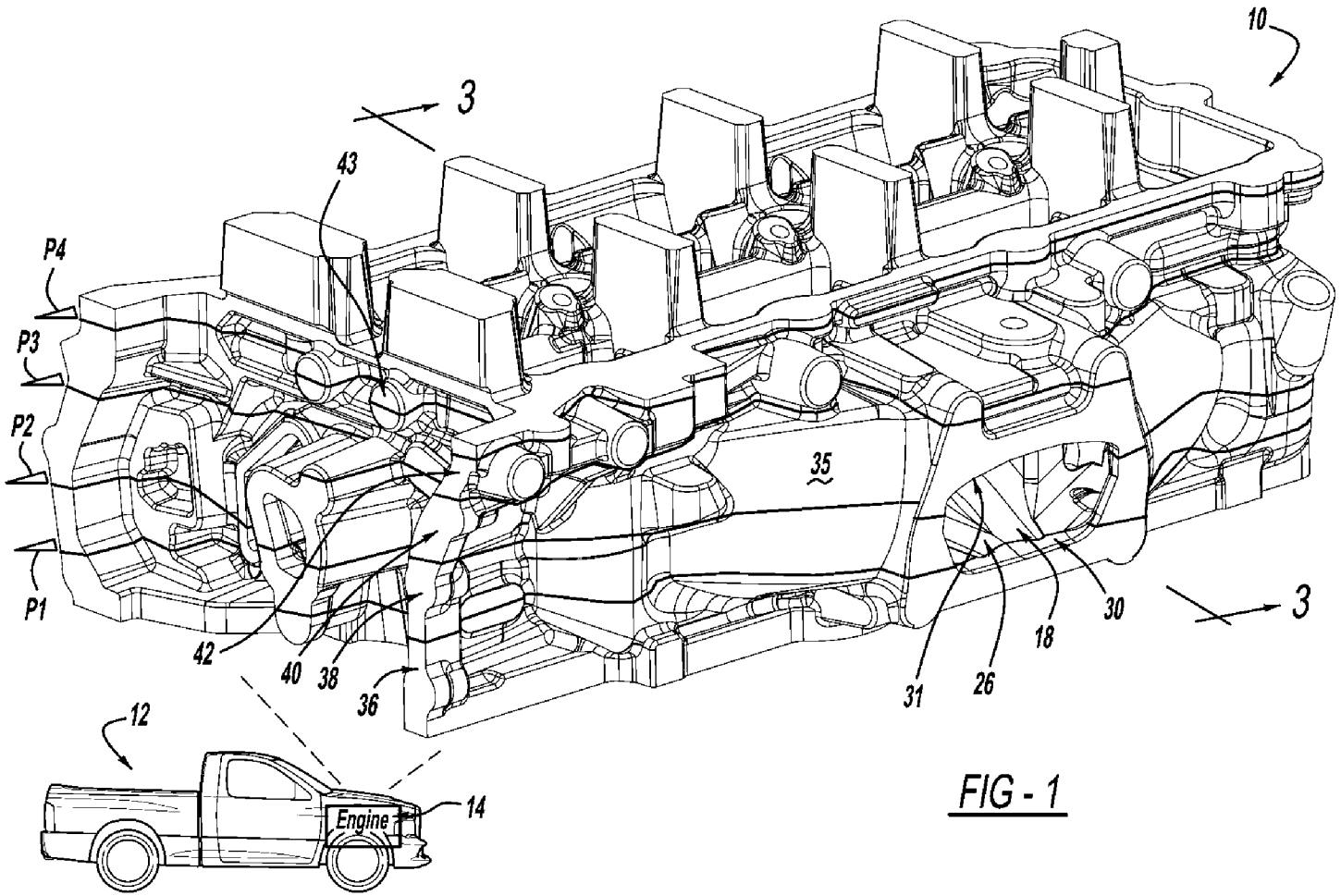
FIG. 1 is a perspective view of a cylinder head assembly of a vehicle having a plurality of layered members according to the present disclosure.

Referring initially to FIG. 1, a cylinder head assembly 10 for a vehicle 12 is illustrated. Although the vehicle 12 illustrated is a pickup truck, it will be appreciated that the vehicle 12 can be of any suitable type, such as a car, SUV, van, motorcycle, etc. Also, it will be appreciated that the cylinder head assembly 10 can be used in association with an engine of any machine other than a vehicle 12 (e.g., lawnmower, etc.).

Figure 3:
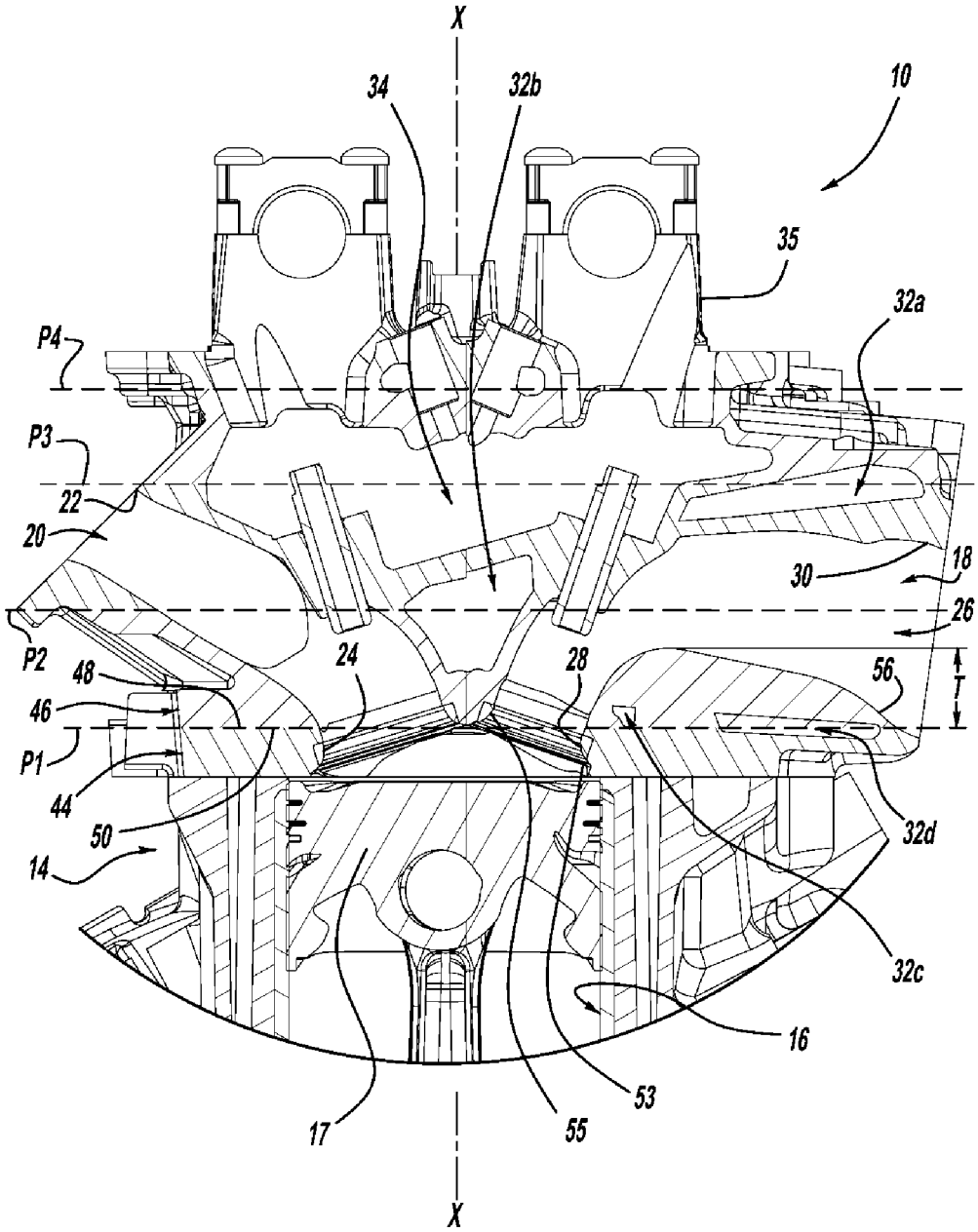
FIG. 3 is a section view of the cylinder head assembly taken along the line 3-3 of FIG. 1, wherein the cylinder head assembly is also shown coupled to an engine block.

The cylinder head assembly 10 can be operably coupled to an engine block 14 (see FIGS. 1 and 3) of an internal combustion engine. The engine block 14 can be of any suitable type (such as a conventional gas or diesel engine block 14), and can include one or more combustion chambers 16. The combustion chambers 16 can have a substantially cylindrical shape and can define an axis X (FIG. 3). Also, a piston 17 can be moveably and operably disposed within the combustion chamber 16.

A fuel-air mixture can be injected through the cylinder head assembly 10, into the combustion chamber 16, and the fuel-air mixture can be ignited to drive the piston 17 therein. The piston 17 can, in turn, drivingly rotate a connecting rod (not shown), and torque of the connecting rod can be transferred through a transmission system (not shown) and to the wheels of the vehicle 12.

The engine block 14 can include any number of combustion chambers 16. Also, the combustion chamber(s) 16 can be arranged relative to each other in any suitable configuration (e.g., V-shape, straight, etc.).

As will be discussed, the cylinder head assembly 10 can be formed from a plurality of separate members that are manufactured independently, then layered and operably coupled (e.g., removably coupled) together. In certain embodiments, the assembly can include a section formed or otherwise manufactured by a different method compared to another section of the assembly. For example, wall thicknesses of the some members can be small enough such that the members can be formed via high pressure die casting or other manufacturing process. Accordingly, the cylinder head assembly 10 can use less material (e.g., aluminum or aluminum alloy) to make. As such, the assembly 10 can be lighter than conventional cylinder heads (e.g., those that are sand cast), and the assembly 10 can be less expensive to manufacture than conventional cylinder heads. In some embodiments, certain sections of the assembly may require different strength, precision, corrosion properties, etc. compared to other sections and therefore the assembly may use differently formed sections.

Referring now to FIGS. 1 and 3, the cylinder head assembly 10 will be discussed in greater detail. It will be appreciated that although FIG. 3 shows only one section of the head assembly 10, other sections of the head assembly 10 can have the same features discussed below.

The cylinder head assembly 10 can include a metallic or otherwise rigid member section. The assembly 10 can have an overall external surface 35 (i.e., peripheral surface). The external surface 35 can include two- or three-dimensionally curved portions and/or the external surface 35 can include substantially flat portions. The external surface 35 can also define recesses and openings for attachment of engine components (e.g., camshaft, etc.).

The cylinder head assembly 10 can have one or more fluid cavities 18 that contain a fluid. The fluid cavities 18 can be of any suitable type and can contain any fluid. The fluid cavities 18 can be entirely defined within the assembly 10 such that the respective fluid is self-contained within the assembly 10. Also, in some embodiments, the fluid cavities 18 can be open through the external surface 35 such that the fluid cavity 18 directs the flow in and/or out of the cylinder head assembly 10.

Specifically, the assembly 10 can include an intake port 20 (see FIG. 3) that directs fluid (e.g., an air-fuel mixture) to the combustion chamber 16. The intake port 20 can include a first terminal end 22 and a second terminal end 24, which are each defined within the external surface 35 of the assembly 10. The intake port 20 can be axially curved from end 22 to end 24. In the embodiments illustrated, fluid flows from the first terminal end 22 to the second terminal end 24. It will be appreciated that the first terminal end 22 can be in fluid communication with a vehicle air intake system (not shown), which includes an air filter, etc. Also, the second terminal end 22 can define a seat for a valve (not shown), which regulates fluid flow into the combustion chamber 16.

The assembly 10 can also include an exhaust port 26 that directs fluid (e.g., exhaust gas) from the combustion chamber 16. The exhaust port 26 can include a first terminal end 28 and a second terminal end 30, which are each defined in the external surface 35 of the assembly 10. The exhaust port 26 can be axially curved from end 28 to end 30. The exhaust port 26 can be disposed on an opposite side of the axis X from the intake port 20 (FIG. 3). In the embodiments illustrated, fluid flows from the first terminal end 28 to the second terminal end 30. It will be appreciated that the first terminal end 28 can define a seat for a valve (not shown), which regulates fluid flow out of the combustion chamber 16. Furthermore, the second terminal end 30 can be in fluid communication with a vehicle exhaust system (not shown), which includes an exhaust pipe, a muffler, a catalytic converter or other exhaust gas treatment device, etc.

Moreover, as shown in FIG. 1, the cylinder head assembly 10 can include a plurality of exhaust ports 26 that are fluidly connected at an exhaust manifold 31. In other embodiments, the plurality of exhaust ports 26 can be fluidly independent of each other within the cylinder head assembly 10. Also, the intake ports 20 can be similarly connected at a manifold (not shown), or the intake ports 20 can be fluidly independent of each other within the assembly 10.

In addition, as best illustrated in FIG. 3, the cylinder head assembly 10 can include one or more coolant jackets 32*a*, 32*b*, 32*c*, 32*d* through which a coolant flows. The coolant jackets 32*a*, 32*b*, 32*c*, 32*d* can be of any suitable shape and can be disposed in any suitable location in the cylinder head assembly 10. For instance, the coolant jacket 32*a* can be disposed above the exhaust port 26. The coolant jacket 32*b* can be centrally located between the intake and exhaust ports 20, 26. The coolant jacket 32*c* can be disposed below the exhaust port 26, adjacent the first end 28. The coolant jacket 32*d* can be disposed below the exhaust port 26, adjacent the second end 30. Moreover, one or more of the coolant jackets 32*a*, 32*b*, 32*c*, 32*d* can be fluidly connected to each other or can be fluidly independent of each other. The coolant jackets 32*a*, 32*b*, 32*c*, 32*d* can contain and direct flow of any suitable coolant (water, antifreeze, etc.). Also, one or more of the coolant jackets 32*a*, 32*b*, 32*c*, 32*d* can include an inlet port or first terminal end (not shown) and an outlet port or second terminal end (not shown) such that the coolant within the jackets 32*a*, 32*b*, 32*c*, 32*d* can flow into and out of the cylinder head assembly 10.

Furthermore, the assembly 10 can include an oil gallery 34 in which a lubricant is contained. The oil gallery 34 can have any suitable shape and can be disposed in any suitable location within the assembly 10. For instance, the oil gallery 34 can be located above the intake and exhaust ports 20, 26. The oil gallery 34 can contain any suitable lubricant (e.g., oil, etc.) for lubricating moving parts (e.g., valves) that are operably coupled to the cylinder head assembly 10. Also, in some embodiments, the oil gallery 34 can include an inlet port or first terminal end (not shown) and an outlet port or second terminal end (not shown) such that the lubricant within the oil gallery 34 can flow into and out of the cylinder head assembly 10. The assembly can also include cavities for other purposes such as certain areas not requiring rigidity can be hollow, or configured to receive a complementary shaped component therein.

As shown in FIGS. 1 and 3, the cylinder head assembly 10 can include and can be cooperatively defined by a plurality of removably coupled members 36, 38, 40, 42, 43. The assembly 10 can include any number of members 36, 38, 40, 42, 43. In the embodiment shown, the assembly 10 includes a first member 36, a second member 38, a third member 40, a fourth member 42, and a fifth member 43. (Only the first and second members 36, 38 are shown exploded from each other in FIG. 2, but it will be appreciated that the third, fourth, and fifth members 40, 42, 43 can share many of the features to be discussed.)

Each of the members 36, 38, 40, 42, 43 are layered over each other and removably coupled to collectively define the assembly 10. In the embodiment shown, the member 36 is disposed directly adjacent the engine block 14, the member 38 is layered over the member 36, the member 40 is layered over the member 38, the member 42 is layered over the member 40, and the member 43 is layered over the member 42. When removably coupled, the members 36, 38, 40, 42, 43 cooperate to define the overall external surface 35 and the various cavities 18 within the cylinder head assembly 10.

As shown in FIGS. 1 and 3, the members 36, 38, 40, 42, 43 can each be parted along respective parting planes P1, P2, P3, P4. The parting planes P1, P2, P3, P4 can be parallel to each other. In the embodiment shown in FIG. 3, the parting planes P1, P2, P3, P4 can be substantially perpendicular to the axis X of the combustion chamber 16. Also, the parting planes P1, P2, P3, P4 can be substantially parallel to the wheelbase of the vehicle 12. In other embodiments, one or more of the members 36, 38, 40, 42, 43 can be parted along lines that do not lie in a single plane. Also, one or more of the parting planes P1, P2, P3, P4 can be non-parallel to each other. Moreover, one or more of the parting planes P1, P2, P3, P4 can be disposed at an acute angle relative to the axis X and/or the wheelbase of the vehicle 12.

The individual members 36, 38, 40, 42, 43 can be individually manufactured using efficient methods and then assembled together. For instance, one or more of the members 36, 38, 40, 42, 43 can be manufactured via a high pressure die casting method. Here, the members 36, 38, 40, 42, 43 can each have a relatively small maximum wall thickness T (FIG. 3) (i.e., the straight-line distance between surfaces of the respective member 36, 38, 40, 42, 43). For instance, the maximum wall thickness T can be between approximately twelve and forty millimeters (12 and 40 mm). However, it will be appreciated that the wall thicknesses of the members 36, 38, 40, 42, 43 can vary according to loading, heat transfer, etc. on the different areas of the members 36, 38, 40, 42, 43. In some embodiments, the wall thickness T can be as low as three millimeters (3 mm) between cavities. Also, in some embodiments, the wall thickness T can be approximately eight millimeters (8 mm) adjacent the combustion chamber 16. It will be appreciated that these relatively low wall thicknesses allow the members 36, 38, 40, 42, 43 to be produced using high pressure die casting methods.

Also, one or more of the members 36, 38, 40, 42, 43 can be made out of aluminum or aluminum alloy using the high-pressure die casting method. As such, the members 36, 38, 40, 42, 43 can be individually cast in a relatively short amount of time (e.g., in a high-volume production environment), and then the members 36, 38, 40, 42, 43 can be layered and coupled together to form the cylinder head assembly 10. Thus, the assembly 10 can be lighter in weight and less expensive to manufacture because the wall thicknesses T can be relatively small and less material (e.g., aluminum or aluminum alloy) is required.

As mentioned, two or more of the members 36, 38, 40, 42, 43 can cooperate to define one or more of the fluid cavities 18 (the intake port 20, the exhaust port 26, the coolant jackets 32*a-d*, and/or the oil gallery 32). As such, the cylinder head assembly 10 can contain and/or route fluids through the cylinder head assembly 10 for operation of the engine 14 as will be discussed.

Figure 2:
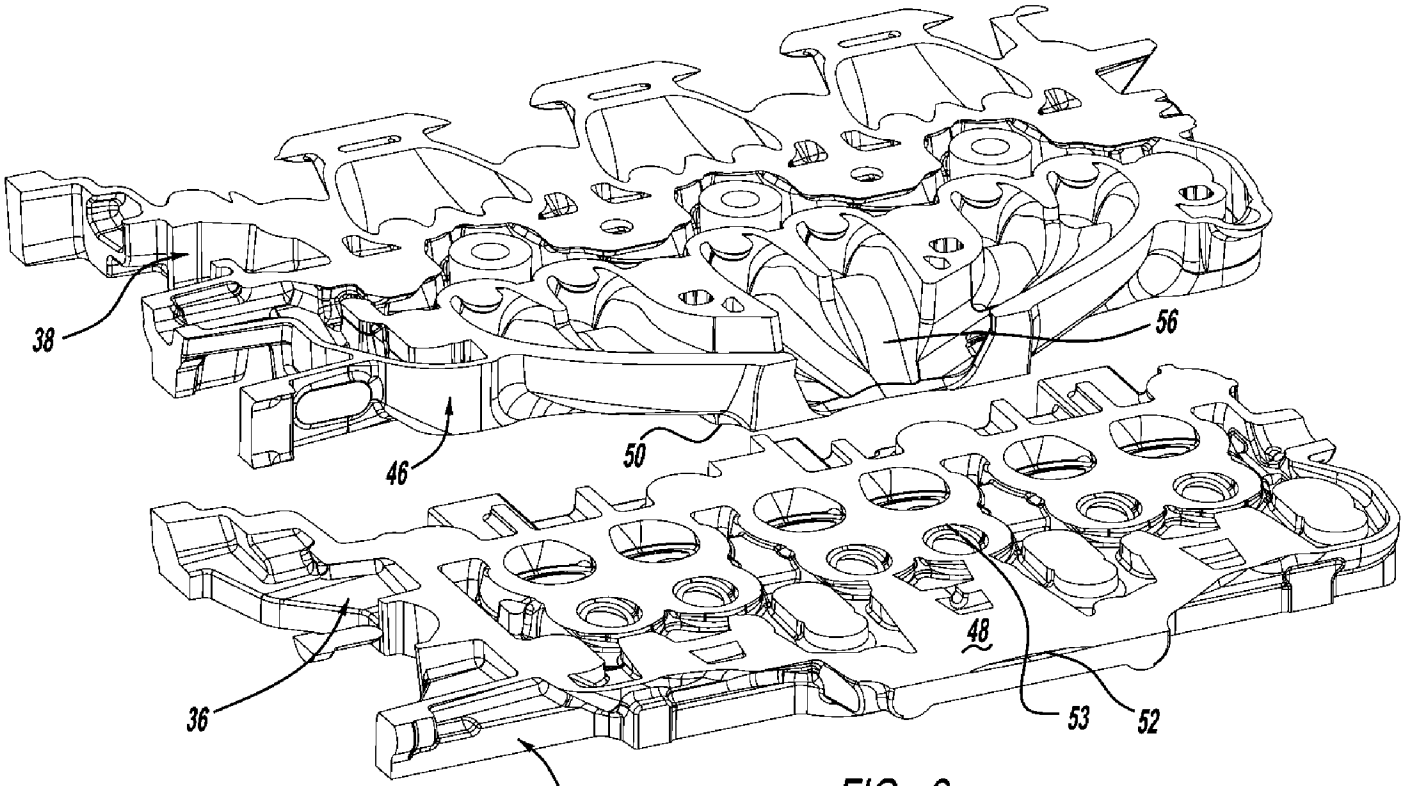
FIG. 2 is a perspective, exploded view of two of the plurality of layered members of FIG. 1.

Referring now to FIG. 2, the members 36, 38 will be discussed in greater detail. Only the members 36, 38 are shown for clarity; however, it will be appreciated that the other members 40, 42, 43 can have various similarities to the members 36, 38.

As shown, the member 36 can include a first exterior surface 44, and the member 38 can include a second exterior surface 46. As shown in FIGS. 1 and 3, when the members 36, 38 are coupled, the first and second exterior surfaces 44, 46 can cooperate to define a corresponding portion of the overall external surface 35 of the cylinder head assembly 10. It will be appreciated that the members 40, 42, 43 can each have a similar corresponding exterior surface that—with the exterior surfaces 36, 38—cooperate to define the entire overall external surface 35.

Furthermore, as shown in FIG. 2, the member 36 can include a first parting surface 48, and the member 38 can include a second parting surface 50. The first and second parting surfaces 48, 50 can be substantially flat and can lie within the first parting plane P1 (FIG. 1). Accordingly, the first and second parting surfaces 48, 50 can abut against each other. In some embodiments, the first and second parting surfaces can abut directly against each other. Also, in some embodiments, a sealing member 94 (FIGS. 4 and 5) can be disposed between the first and second parting surfaces 48, 50. The sealing member 94 can be of any suitable type for sealing the first and second members 36, 38 together. For instance, the sealing member 94 can be a room temperature vulcanizer (RTV). It will be appreciated that the members 40, 42, 43 of the assembly 10 can also include respective parting surfaces that abut with or without the sealing member 94 therebetween. In another embodiment, two adjoining sections may include an area with a particular sealing member between them while another area between the same two adjoining sections or two other sections can include a different sealing member, to accommodate different fluids, pressures, material surface conditions etc.

As mentioned above, the members 36, 38 can cooperate to define the cavities 18 within the cylinder head assembly 10. As shown in FIGS. 2 and 3, the first member 36 can include a first internal surface 52, and the second member 38 can include a second internal surface 56. The first and second internal surfaces 52, 56 can cooperate to define a portion of the exhaust port 26. Specifically, the first and second internal surfaces 52, 56 cooperate to define a portion of the second terminal end 30 of the exhaust port 26.

It will be appreciated that the first and second internal surfaces 52, 56 are ones of a plurality of similar internal surfaces that cooperate to define other portions of the exhaust port 26. For instance, as shown in FIGS. 2 and 3, the first member 36 can include a third internal surface 53, and as shown in FIG. 3, the second member 38 can include a fourth internal surface 55. As shown in FIG. 3, the third and fourth internal surfaces 53, 55 cooperate to define the first terminal end 28 of the exhaust port 26. Also, as shown in FIG. 3, the second member 38 and third member 40 cooperate to define the exhaust port 26 between the first and second terminal ends 28, 30. Thus, the first, second, and third members 36, 38, 40 cooperate to define the entire exhaust port 26 between the first and second terminal ends 28, 30.

It will be appreciated that the first member 36 and second member 38 can include other internal surfaces that cooperate to define other cavities 18 within the assembly 10, such as portions of the intake port 20 (e.g., adjacent the second terminal end 24 as shown in FIG. 3). Also, it will be appreciated that the other members 40, 42, 43 can each include respective internal surfaces that cooperate to define the intake port 20, the exhaust port 26, the coolant jackets 32*a-d*, and/or the oil gallery 34. It will be appreciated that any number of the members 36, 38, 40, 42, 43 can cooperate to define any one of the cavities 18. It will also be appreciated that the parting planes P1-P4 and/or the shape of the members 36, 38, 40, 42, 43 can be adapted according to the desired shape of the cavities 18, according to manufacturing variables (e.g., wall thicknesses T of the members 36, 38, 40, 42, 43), according to heat transfer characteristics of the members 36, 38, 40, 42, 43, or according to any other factor. Moreover, it will be appreciated that any of the cavities 18 can be defined by a single one of the members 36, 38, 40, 42, 43 without departing from the scope of the present disclosure.

Figure 4:
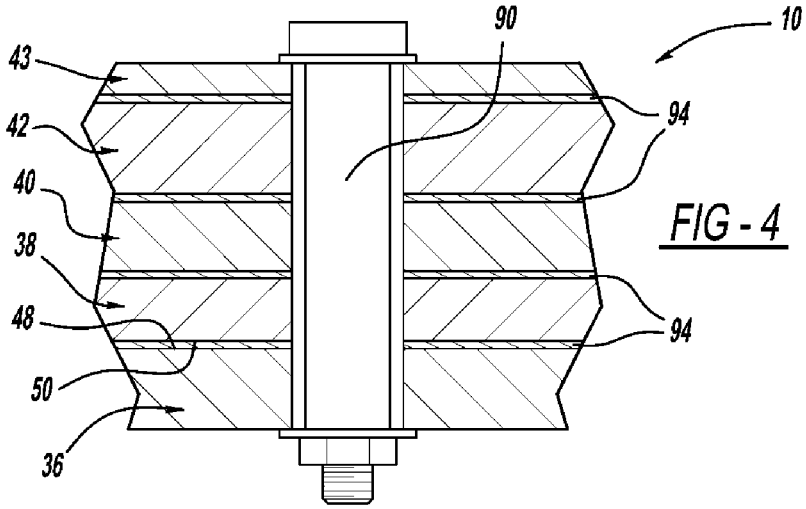
FIG. 4 is a section view of the cylinder head assembly of FIG. 1 with a fastener that operably couples the plurality of layered members together.
Figure 5:
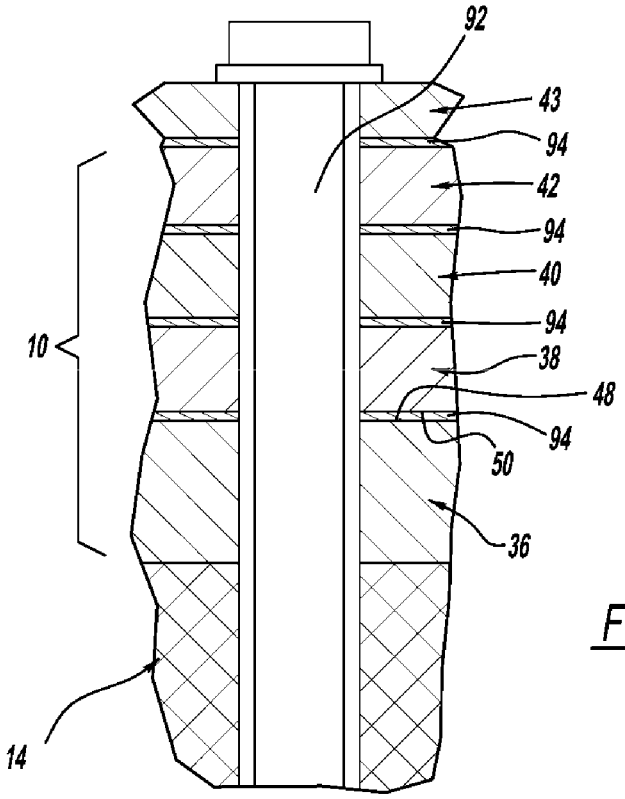
FIG. 5 is a section view of the cylinder head assembly of FIG. 1 with a fastener that operably couples the plurality of layered members to an engine block.

The members 36, 38, 40, 42, 43 can be coupled in any suitable fashion. For instance, as shown in FIG. 4, one or more fasteners 90 (e.g., bolts, nuts, screws, etc.) can be used to removably couple and fasten the layered members 36, 38, 40, 42, 43 together. Also, in some embodiments as shown in FIG. 5, one or more fasteners 92 can be used to fasten and removably couple the layered members 36, 38, 40, 42, 43 together as well as removably couple the assembly 10 to the engine block 14. It will be appreciated that the fasteners 90, 92 can couple any of the members 36, 38, 40, 42, 43 together. It will also be appreciated that the fasteners 92 can couple any of the members 36, 38, 40, 42, 43 to the engine block 14.

Moreover, in some embodiments, the members 36, 38, 40, 42, 43 are attached together and/or the members 36, 38, 40, 42, 43 are attached to the engine block 14 via other means. For instance, adhesives, welds, or other means are used for coupling these components together. In each of these embodiments, the sealing members 94 can seal the respective members 36, 38, 40, 42, 43 together and/or the sealing members 94 can seal the respective cavities 18.

Thus, in summary, the members 36, 38, 40, 42, 43 can each be individually manufactured (e.g., by high pressure die casting). This can improve manufacturing efficiency of the cylinder head assembly 10, can reduce weight, and can reduce cost as compared to conventional cylinder heads.

What is claimed is:

1. A cylinder head assembly for an internal combustion engine, the cylinder head assembly including a fluid cavity that contains a fluid, the cylinder head assembly comprising:

a first member with a first internal surface defining a first part of the fluid cavity; and a second member with a second internal surface defining a second part of the fluid cavity, the second member coupled to the first member, the first and second internal surfaces cooperating to define the fluid cavity, wherein the first and second members cooperate to define an external surface of the cylinder head assembly, and wherein the first and second internal surfaces and the external surface cooperate to define an opening of the fluid cavity, the cylinder head assembly further comprising a third member that cooperates with the first and second members to define the external surface of the cylinder head assembly, the third member having a third internal surface that cooperates with the first and second internal surfaces to define the opening of the fluid cavity.

2. The cylinder head assembly of claim 1, wherein the fluid cavity is at least one of an intake port that directs fluid to a combustion chamber, an exhaust port that directs fluid from the combustion chamber, a coolant jacket through which a coolant flows, and an oil gallery in which a lubricant is contained.

3. The cylinder head assembly of claim 1, wherein the first member includes a first parting surface and the second member includes a second parting surface, the first and second parting surfaces each being substantially flat, the first and second parting surfaces layered on each other.

4. The cylinder head assembly of claim 3, wherein the cylinder head assembly is operable to be coupled to an engine block having a combustion chamber, the combustion chamber having an axis, the first and second parting surfaces being substantially normal to the axis.

5. The cylinder head assembly of claim 1, further comprising a sealing member disposed between the first and second members.

6. The cylinder head assembly of claim 1, further comprising a fastener that removably couples the first and second members together.

7. The cylinder head assembly of claim 6, wherein the fastener also removably couples the first and second members to an engine block.

8. The cylinder head assembly of claim 1, wherein the first and second members are high pressure die cast.

9. A method of forming a cylinder head assembly for an internal combustion engine comprising:

forming a first member of the cylinder head assembly, the first member including a first internal surface;

forming a second member of the cylinder head assembly, the second member including a second internal surface; and coupling the first and second members together such that the first and second internal surfaces cooperate to define a fluid cavity that contains a fluid, wherein the first and second members cooperate to define an external surface of the cylinder head assembly, and wherein the first and second internal surfaces and the external surface cooperate to define an opening of the fluid cavity, the method further comprising forming a third member wherein the first, second and third members cooperate to define the external surface of the cylinder head assembly and wherein the external surface and the first and second internal surfaces cooperate with a third internal surface of the third member to define the opening of the fluid cavity.

10. The method of claim 9, wherein the fluid cavity is at least one of an intake port that directs fluid to a combustion chamber, an exhaust port that directs fluid from the combustion chamber, a coolant jacket through which a coolant flows, and an oil gallery in which a lubricant is contained.

11. The method of claim 9, wherein forming the first member includes forming a first parting surface, wherein forming the second member includes forming a second parting surface, the first and second parting surfaces each being substantially flat, and wherein coupling the first and second members together includes layering the first and second parting surfaces on each other.

12. The method of claim 9, further comprising providing a sealing member between the first and second members.

13. The method of claim 9, wherein at least one of forming the first, second and third members includes high pressure die casting at least one of the first, second and third members.

14. The method of claim 13, wherein at least one of the first, second and third members are high pressure die cast out of one of an aluminum material and an aluminum alloy material.

15. A method of forming a cylinder head assembly for an internal combustion engine comprising:

forming a first member of the cylinder head assembly, the first member including a first internal surface;

forming a second member of the cylinder head assembly, the second member including a second internal surface; and coupling the first and second members together such that the first and second internal surfaces cooperate to define a fluid cavity that contains a fluid, wherein the first and second members cooperate to define an external surface of the cylinder head assembly, and wherein the first and second internal surfaces and the external surface cooperate to define an opening of the fluid cavity, the method further comprising forming a third member having a third internal surface and coupling the third member to the first and second members, wherein the third internal surface cooperates with the first and second internal surfaces to define the fluid cavity.

16. The method of claim 15, wherein coupling the first, second and third members together includes removably coupling the first, second and third members to an engine block with a common fastener.

* * * * *